US006036453A

United States Patent [19]

Zepp et al.

[11] Patent Number: 6,036,453

[45] **Date of Patent: *Mar. 14, 2000**

[54] PUMP ASSEMBLY

[75] Inventors: Lawrence P. Zepp, Fort Wayne; Robert J. Loubier, Roanoke, both of Ind.

[73] Assignee: Xolox Corporation, Fort Wayne, Ind.

[ * ] Notice: This patent is subject to a terminal disclaimer.

[21] Appl. No.: 09/021,239

[22] Filed: Feb. 10, 1998

Related U.S. Application Data

[63] Continuation-in-part of application No. 08/436,170, May 9, 1995, Pat. No. 5,725,312.

[51] Int. Cl.[7] ..... F04B 17/00

[52] U.S. Cl. ..... 417/410.4; 417/366

[58] Field of Search ..... 417/410.4, 366, 417/360, 370, 410.3

[56] References Cited

U.S. PATENT DOCUMENTS 5,725,362 3/1998 Zepp et al. ..... 417/366

*Primary Examiner*—Teresa Walberg
*Assistant Examiner*—Vinod D Patel
*Attorney, Agent, or Firm*—Barnes & Thornburg

[57] ABSTRACT

A pump assembly which includes a pump head which is driven by a rotor that is located in a housing to which the pump head is attached. The pump head includes a drive gear and a driven gear. The drive gear is coupled to the rotor by a shaft which is received at opposite ends by a bearing located in a closed end of the rotor housing and a bearing which is located in the pump head.

23 Claims, 7 Drawing Sheets

PUMP ASSEMBLY

RELATED APPLICATION

This application is a continuation-in-part of U.S. patent application Ser. No. 08/436,170, filed May 9, 1995, now U.S. Pat. No. 5,725,312, the complete disclosure of which is hereby expressly incorporated by reference.

BACKGROUND AND SUMMARY OF THE INVENTION

The present invention relates to a pump assembly design and to a method of making a pump assembly. More particularly, the present invention relates to a pump assembly design having increased efficiency, life, and dependability, as well as increased strength, rigidity, compatibility, and insulative characteristics over current pump assembly designs.

Pump assemblies have application in a variety of areas. Some of these assemblies are driven by motors that require a seal between the motor and a fluid being pumped to prevent the fluid from contacting the motor. Often, the seal is mounted on a shaft of the assembly that is driven by the motor. Over time, this seal tends to wear and, if not periodically checked and replaced, will allow fluid to contact the motor and damage it.

Some pump assembly designs utilize magnetic coupling between drive and driven motor members. Bumping or jarring of certain of these pump assembly designs can cause the drive and driven members to uncouple. When uncoupled, the motor of the assembly continues to operate but no pumping occurs. Pumping is reinitiated if the motor is turned off and restarted.

For pump assemblies to work efficiently and last, the drive components should be aligned. Also, misalignment of pump assembly drive components causes friction which increases wear and stresses of the components of the assembly.

Another pump assembly design consideration is dissipation of heat away from the assembly that is generated by the assembly electronics as well as the fluid being pumped. Excessive heat can stress components of these assemblies, such as electronics and bearings in which pump shafts are journaled.

A further consideration with certain pump assembly designs is compatibility with the fluid or fluids pumped. The materials from which these pumps are formed should be compatible or inert with fluids being pumped so these fluids do not become contaminated. Use of pump assemblies in the medical field, for such applications as kidney dialysis, is an example of where such compatibility or inertness is important.

In addition to forming an assembly from compatible or inert materials, it is also desirable to form pump assemblies from materials that are wear resistant and strong. This helps both protect the assemblies from damage by surrounding objects, as well as to increase the life and dependability of such assemblies.

The present invention is designed and directed to solving these above-described problems and meeting these above-described needs. An embodiment of the present invention includes a frame, a stator coupled to the frame, a rotor drivingly associated with the stator and configured to include a bore, and a housing configured to define a cavity in which the rotor is disposed, the cavity having a closed end and an open end. The embodiment also includes a first bearing secured in the closed end of the housing, a pump disposed adjacent to and driven by the rotor and stator, and a shaft coupled to the pump, disposed within and extending through the bore of the rotor, and journaled in the first bearing.

This embodiment of the present invention may also include a second bearing secured in the pump in which the shaft is journaled. In addition, the housing may be configured to include a flange adjacent the open end to which the pump is attached.

This embodiment of the present invention may further include an alignment spacer adjacent the open end of the housing and the pump that reduces lateral shifting of the pump relative to the housing. The alignment spacer may also be adjacent the open end of the housing and the pump to help facilitate alignment of a center of a bore through the first bearing with a center of a bore of the second bearing. The alignment spacer may be attached to the second bearing so that an inside periphery of the alignment spacer is in contact with an outside periphery of the second bearing and an outside periphery of the alignment spacer is in contact with an inside periphery of the open end of the housing. A seal may be disposed between the alignment spacer and a body of the pump. This seal may be positioned so as to be adjacent the pump, the inside periphery of the open end of the housing, and the outside periphery of the alignment spacer. In one or more embodiments, this seal may be an O-ring seal.

The alignment spacer may be configured to include a plurality of apertures in fluid communication with the pump and the cavity of the housing to thereby define a fluid flowpath including the pump, the alignment spacer, and the cavity of the housing. The first and second bearings may be configured to each include a channel. The channel in the first bearing may be in fluid communication with the cavity and the channel in the second bearing may be in fluid communication with the pump and the cavity of the housing. In this embodiment including the channels, a fluid flowpath may be defined from the pump, through the channel in the second bearing, through the cavity, the channel in the first bearing, the bore in the rotor, through the alignment spacer, and back to the pump.

The pump may include an inlet, an outlet, a gear, and a shaft. In this embodiment, a channel is formed in the first bearing. Also, in this embodiment, the gear and shaft are each configured to include a longitudinally extending bore therethrough. These bores are substantially aligned so that a fluid flowpath is defined through the bore in the gear and the bore in the shaft, to the channel in the first bearing, and to the cavity and the bore of the rotor. In this embodiment, the first bearing may be configured to include a recessed counterbore and an end of a body of the rotor may be configured to include a nose disposed adjacent the recessed counterbore to define a clearance between the nose and the recessed counterbore of the first bearing through which fluid in the fluid flowpath flows.

In embodiments of the invention including bearings, grooves may be formed in the outside peripheries of these bearings. Fluid pumped by the assembly flows or circulates through these grooves to help cool the bearings.

Allowing fluid pumped by the assembly to circulate in the manner described above lubricates the assembly. In addition, allowing such fluid flow provides for dissipation of heat generated during operation.

In embodiments of the present invention that include a shaft and one or more bearings, the shaft is journaled in the bearings and the rotor includes a body configured to define a bore in which the shaft is disposed. The shaft and bore may be configured so that the rotor is substantially restricted from movement about a longitudinal axis of the shaft and substantially unrestricted from movement in a direction along the longitudinal axis of the shaft. This allows the rotor to self-center within the stator so as to maximize energy transfer between the stator and rotor. The longitudinal bore extending through the body may be configured to include a key extending along a longitudinal length of the body that is received within a longitudinal slot formed in the shaft so that the key engages the slot to allow the rotor to move as described above. The body of the rotor may also be configured to provide a thrust surface for contact with one or more of the bearings.

The above-described components of the pump assembly constructed in accordance with the present invention are made from a material that is compatible or inert with the fluid being pumped. This helps reduce contamination of fluids pumped by the assembly and attack of the pump structure as well.

The rotor may be formed to include the above-described body and, in addition, a tube adjacent the body, a magnet adjacent the tube, and a shell adjacent the magnet so that the magnet is between the shell and tube. In one embodiment of the rotor, the body is made of polyphenylene sulfide polymer, the tube is made of steel, the magnet includes neodymium, iron, and boron, and the shell is stainless steel. The body may be made from other similar polymers as well.

In one or more embodiments of the pump assembly constructed in accordance with the present invention, the alignment spacer is made of plastic. Material reinforcements and lubricants are added to increase the strength and wear resistance of the alignment spacer. The above-described bearings may also be made of plastic. Material reinforcements and lubricants may be added to these bearings as well.

The housing may be made of a plastics material, and, in one embodiment, is a liquid crystal polymer. Use of a plastics material for the housing, in addition to providing compatibility, also helps provide heat insulation to electronic components used to control the operation of the pump assembly.

Another embodiment of a pump assembly constructed in accordance with the present invention, includes a frame, a stator coupled to the frame, a rotor associated with the stator, and a housing configured to define a cavity having an open end. This embodiment also includes a pump, driven by the rotor and stator, that includes a body secured to the housing, and an alignment spacer, adjacent the open end of the housing and the body of the pump, that reduces lateral shifting of the pump relative to the housing.

The open end of the housing may include an inside periphery and the alignment spacer may include an outside periphery in contact with the inside periphery of the housing. This embodiment may also include a seal adjacent the outside periphery of the alignment spacer, the inside periphery of the open end, and the body of the pump. This seal may be an O-ring seal.

This embodiment may further include the above-described first and second bearings, shaft, and fluid flowpaths. In addition, the alignment spacer may be positioned on the second bearing, as described above, and may also help facilitate substantial alignment of a center of the first bearing with a center of the second bearing.

The pump of this embodiment may include a drive member disposed within the pump and drivingly associated with a driven member also disposed within the pump. The shaft may be attached to the drive member. In one embodiment, the drive member may be a drive gear and the driven member may be a driven gear. The drive gear may include first and second faces and the driven gear may include third and fourth faces. In these embodiments, an insert may be positioned adjacent both the first and third faces and the second and fourth faces of the gears to reduce wear. These inserts also increase the dry run capability of the assembly. These inserts may be made from graphite and carbon.

This embodiment of the pump assembly constructed in accordance with the present invention may also be made from materials described above in connection with the first embodiment.

As discussed above, the present invention also relates to a method of making a pump assembly that includes a housing, a first bearing, a second bearing having an outside periphery, a body, and an alignment spacer having an inside periphery and an outside periphery. The method includes the steps of forming the housing to include a cavity having a closed end and an open end with an inside periphery. This method also includes the steps of securing the first bearing in the closed end of the housing, securing the second bearing in the body, attaching the alignment spacer to the second bearing so that the inside periphery of the alignment spacer is in contact with the outside periphery of the second bearing, and positioning the body adjacent the housing so that the inside periphery of the alignment spacer is in contact with the inside periphery of the open end, thereby substantially aligning a center of an opening through the first bearing with a center of an opening through the second bearing. The method in accordance with the present invention may also include forming the housing by forcing a plastics material through a mold so that the resulting structure is substantially free from knit lines normally caused by different plastic material flow fronts meeting one another. This helps increase the structural integrity of the housing. In one embodiment, the plastics material is a liquid crystal polymer which further helps increase the structural integrity of the rotor housing due to the relatively long molecular structure of such material.

The method may also include the step of ultrasonically welding the first bearing in the closed end of the housing and ultrasonically welding the second bearing in the body. The method may further include the steps of forming the housing to include a flange adjacent the open end and attaching the body of the pump to the flange.

Other objects, advantages and novel features of the present invention will become apparent from the following detailed description of the invention when considered in conjunction with the accompanying drawings.

DETAILED DESCRIPTION OF THE DRAWINGS

Figure 1:
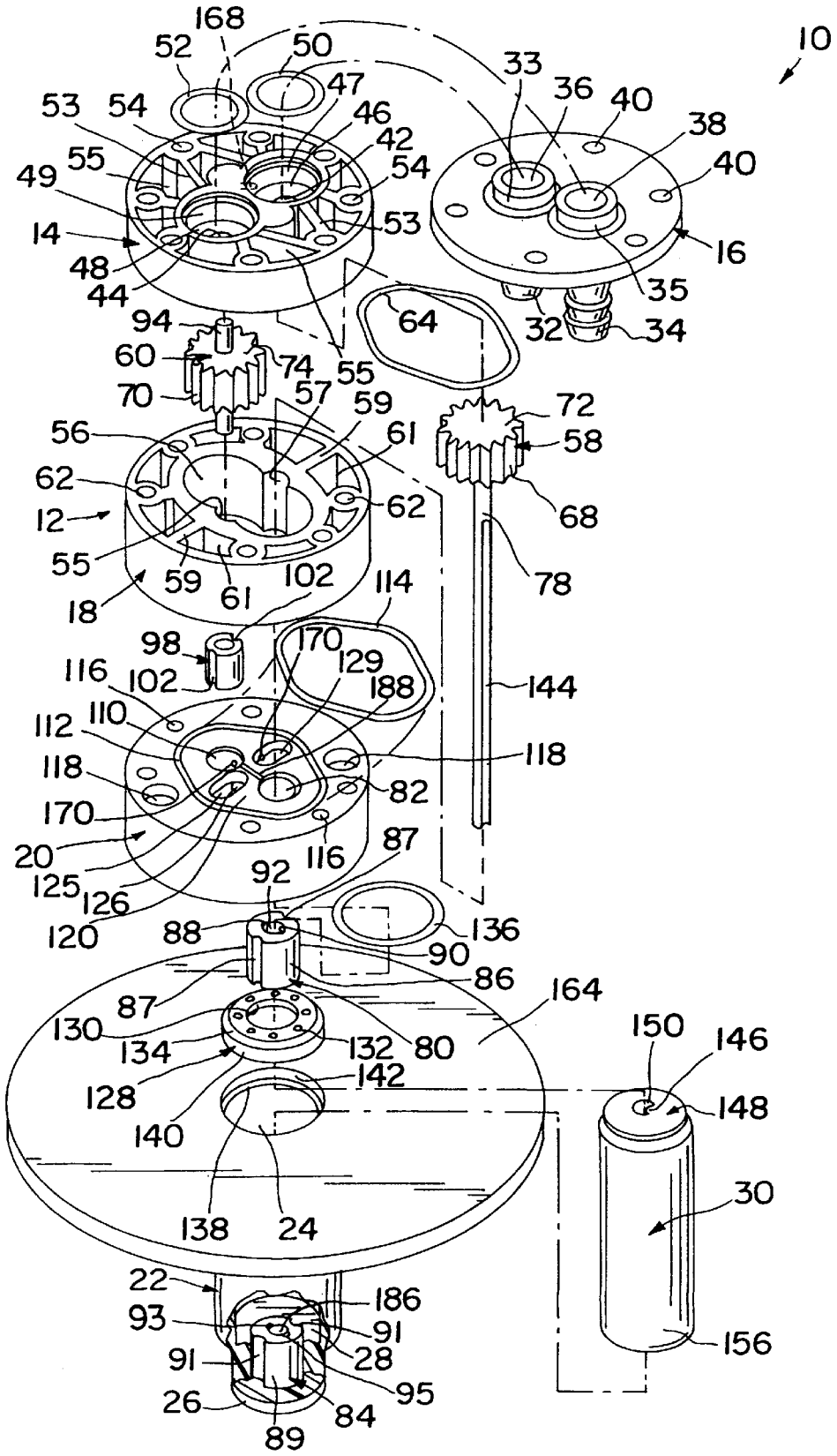
FIG. 1 is an exploded perspective view of an embodiment of a pump assembly constructed in accordance with the present invention.

An exploded perspective view of a pump assembly 10 constructed in accordance with the present invention is shown in FIG. 1. Pump assembly 10 includes a pump 12 having a cover 14, a cover plate 16, a body 18, and a base 20. Pump assembly 10 also includes a rotor housing 22 having an open end 24, a closed end 26, and a cavity 28 in which a rotor 30 is disposed via open end 24. Cover plate 16 includes a pair of ports 32 and 34 through which fluid pumped by assembly 10 is both introduced and exits. Ports 32 and 34 include respective openings 36 and 38. Coverplate 34 is also formed to include a plurality of apertures 40 through which fasteners and dowels are disposed as discussed more fully below.

Cover 14 includes a pair of ports 42 and 44 in fluid communication with respective ports 32 and 34. Ports 42 and 44 are adjacent respective cavities 46 and 48 defined by respective walls 47 and 49. A pair of seals 50 and 52 are respectively disposed on shoulders 33 and 35 of respective ports 36 and 38 and within cavities 46 and 48 to provide a substantially fluid tight connection between shoulders 33 and 35 of respective ports 32 and 34 and cover 14. Cover 14 is further formed to include a plurality of apertures 54 that receive the above-described fasteners and dowels and a plurality of walls 53 that define cavities 53 located between adjacent walls 53.

Body 18 includes a gear pocket 56 in which both drive gear 58 and driven gear 60 are disposed. Body 18 is also formed to include channels or grooves 55 and 57, walls 59, and cavities 61 defined between adjacent walls 59. Although drive and driven gears 58 and 60 are shown as the drive and driven members for pump 12, it is to be understood that use of other members, such as impellers or vanes, are within the scope of the present invention.

Body 18 also includes a plurality of apertures 62 that receive the above-described fasteners and dowels. A seal 64 is positioned to lie within a groove 66 in cover 14 (see FIG. 2) to provide a substantially fluid tight seal between cover 14 and body 18.

As can be seen in FIG. 1, drive gear 58 includes a plurality of teeth 68 that mesh with teeth 70 of driven gear 60. Although teeth 68 and 70 are shown as being substantially straight, it is to be understood that they may have other shapes as well. For example, in embodiments of assembly 10, teeth 68 and 70 may be helical. Drive and driven gears 58 and 60 also include respective faces 72 and 74 that lie adjacent an insert 76 (see FIG. 2) in cover 14. In one or more embodiments of the present invention, insert 76 is made of graphite and carbon. Insert 76 helps reduce friction and wear of faces 72 and 74. In addition, insert 76 increases the dry run capability of assembly 10.

Figure 2:
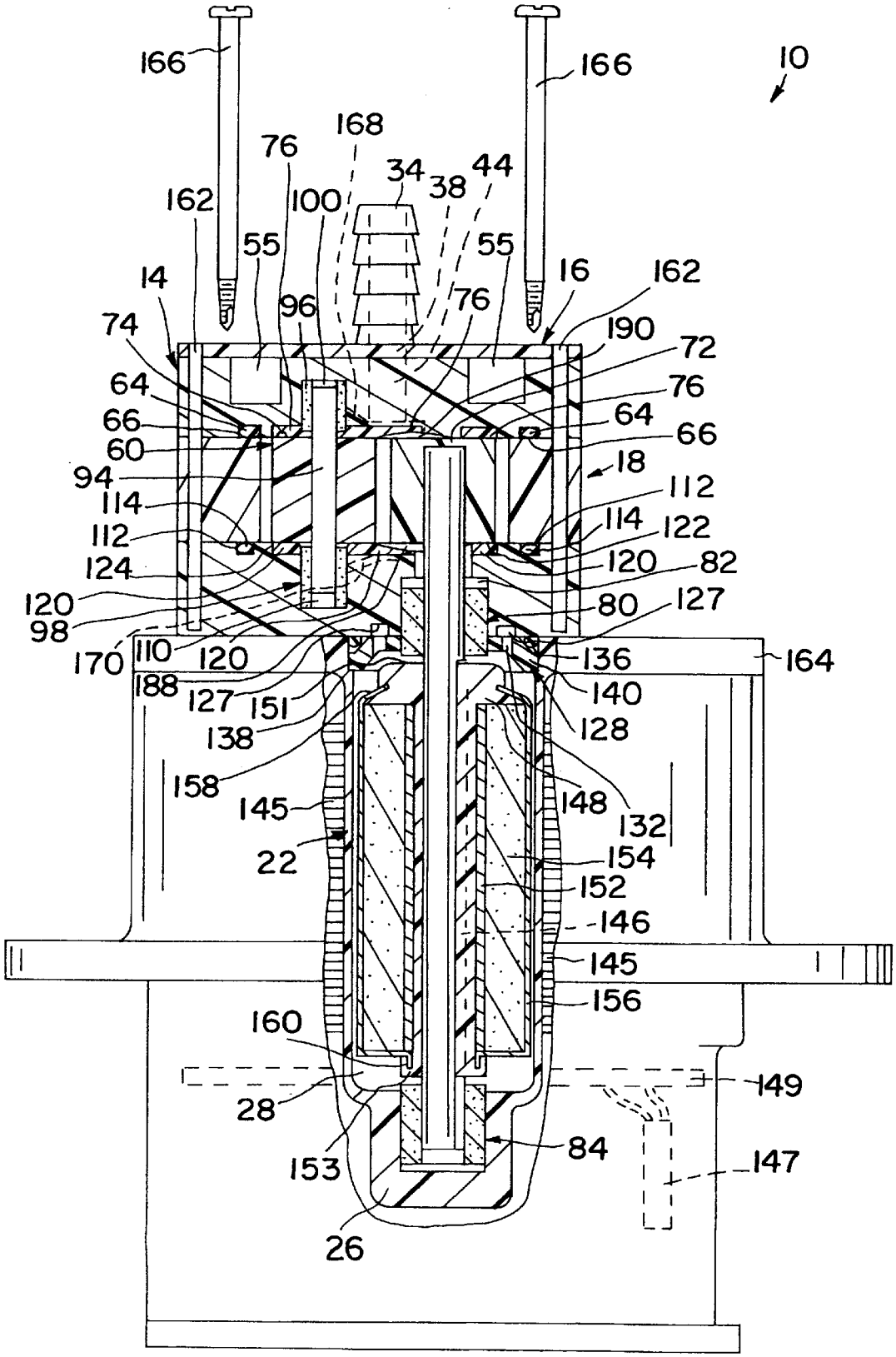
FIG. 2 is a longitudinal cross-sectional view of the pump assembly shown in FIG. 1.

As shown in FIGS. 1 and 2, drive gear 58 is attached to a drive shaft 78 that is journaled within drive bearing 80, secured within drive bearing cavity 82 of base 20, and drive bearing 84 secured within closed end 26 of rotor housing 22. Drive bearing 80 includes an outer periphery 86 and grooves 87 through which fluid flows to help cool bearing 80. Drive bearing 80 is also formed to include a pair of longitudinally extending channels 88 and 90 adjacent bore 92, the purpose of which is more fully discussed below. Drive bearing 84 also includes an outer periphery 89 and grooves 91 through which fluid flows to help cool bearing 84. In addition, bearing 84 may be formed according to one embodiment to include a pair of longitudinally extending channels 93 and 95 adjacent bore 186, the purpose of which is more fully discussed below.

Driven gear 60 is attached to driven gear shaft 94 that is journaled within driven gear bearings 96 and 98 respectively disposed within driven bearing cavities 100 and 110 formed in cover 14 and base 20. Bearings 96 and 98 may be secured in respective cover 14 and base 20 by such means as ultrasonic welding. As can be seen in FIG. 1, driven gear bearing 98 includes grooves 102 through which fluid flows to help cool bearing 98 as discussed above in connection with grooves 87 formed in drive bearing 80. Although not shown, driven gear bearing 98 includes similar grooves 102.

Base 20 is formed to include a groove 112 into which seal 114 is positioned to lie to provide a substantially fluid- tight seal between body 18 and base 20. Base 20 is also formed to include a plurality of fastener apertures 116 and dowel apertures 118 that receive the above-described fasteners and dowels.

An insert 120, like insert 76, lies adjacent faces 122 and 124 of respective drive and driven gears 58 and 60. Insert 120 helps reduce friction and wear of faces 122 and 124 (see FIG. 2) of respective drive and driven gears 58 and 60. In addition, insert 120 increases the dry run capability of assembly 10. In one or more embodiments of the present invention, insert 120 is made from graphite and carbon. Cavities 125 and 129 are formed in insert 120 and may also be formed in a portion of base 20. Alternatively, insert 120 may be formed to define cavities 125 and 129. A port 126 is formed in base 20 to provide for fluid communication with gear pocket 56 of body 18 and cavity 28 of rotor housing 22.

Pump assembly 10 further includes an alignment spacer 128 that is mounted on drive bearing 80 so that an inner periphery 130 of alignment spacer 128 is adjacent outer periphery 86 of bearing 84. Alignment spacer 128 is configured to include a plurality of apertures 132 aligned with groove 127 in base 20 (see FIG. 2) to provide for fluid communication between base 20 and cavity 28 of rotor housing 22 via port 126. Alignment spacer 128 is also configured to include a rim 134 on which seal 136 is positioned to lie. Seal 136 provides for substantially fluid-tight communication between groove 127 formed in base 20 and apertures 132 formed in alignment spacer 128. In one embodiment, seal 136 is an O-ring.

As shown in FIGS. 1 and 2, ledges 138 are formed on rotor housing 122 adjacent cavity 28 on which alignment spacer 128 is disposed so that an outer periphery 140 of alignment spacer 128 lies adjacent an inner periphery 142 of rotor housing 22 in the vicinity of open end 24.

As also shown in FIG. 1, drive shaft 78 is formed to include a keyway or slot 144 that receives a key 146 of rotor 30. This arrangement allows rotor 30 to generally freely move along a longitudinal length or axis of drive shaft 78 so that rotor 30 can self-enter with stator 145 (see FIG. 2) but be substantially restricted from rotational movement about shaft 78 to reduce "play" in the driving engagement between rotor 30 and drive shaft 78.

In one or more embodiments of assembly 10, drive gear bearings 80 and 84, as well as driven gear bearings 96 and 98, are made of plastic. This plastic may include a polyphenylene sulfide polymer with material reinforcements and lubricants. Drive gear 58 and driven gear 60, as well as alignment spacer 128, may also be made of plastic. This plastic may also include a polyphenylene sulfide polymer with material reinforcements and lubricants. Cover 14, cover plate 16, body 18, and base 20 may additionally be made of a plastic material. This plastic material may also have the same material reinforcements and lubricants as drive gear 58 and driven gear 60. Rotor housing 22 may further be made of plastic. This plastic may be a liquid crystal polymer. There are at least two advantages to molding rotor housing 22 from plastic. The first is that drive bearing 84 is rigidly coupled in rotor housing 22. The second is that the use of plastic provides good heat insulation for control components of assembly 10, such as circuit component 147 mounted on circuit board 149 shown in FIG. 2, which can be damaged by excessive heat.

As shown in FIG. 2, rotor 30 includes a body 148 formed to include a bore 150 through which drive shaft 78 extends. Body 148 is also formed to include the above-described key 146. Rotor 30 also includes a tube 152 adjacent body 148, a magnet 154 adjacent tube 152 and a shell 156 adjacent magnet 154. Shell 156 is formed to include a pair of turned ends 158 and 160 disposed within a portion of body 148 to help secure shell 156 to body 148. Ends 151 and 153 of body 148 adjacent respective drive bearings 80 and 84 provide thrust surfaces for movement of rotor 30 along a longitudinal axis of or length drive shaft 78, as discussed above.

As shown in FIG. 2, cover 14, cover plate 16, body 18, and base 20 are aligned by dowels 162 disposed through the above-described apertures in these members. In the embodiment of the present invention shown, dowels 162 do not enter flange 164 of rotor housing 22. Rather, cover 14, cover plate 16, body 18, and base 20 are secured together by fasteners 166 that pass through the above-described apertures in these members. Base 20, in turn, is secured to flange 164 of housing 22 by fasteners (not shown). These apertures may already be formed in flange 164 or made by the fasteners.

Both cover 14 and base 20 are formed to include respective driven gear bearing ports 168 and 170 that provide respective driven gear bearings 96 and 98 with fluid pumped by assembly 10 to cool these bearings during operation of assembly 10.

Figure 3:
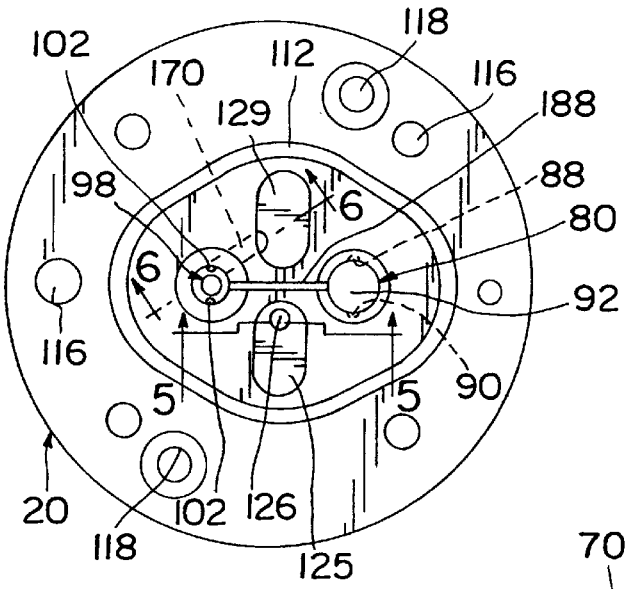
FIG. 3 is a top view of a base of the pump assembly shown in FIGS. 1 and 2.
Figure 5:
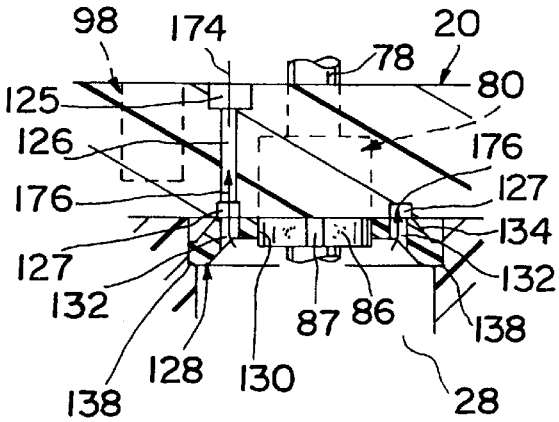
FIG. 5 is a cross-sectional view taken along lines 5—5 of FIG. 3.
Figure 4:
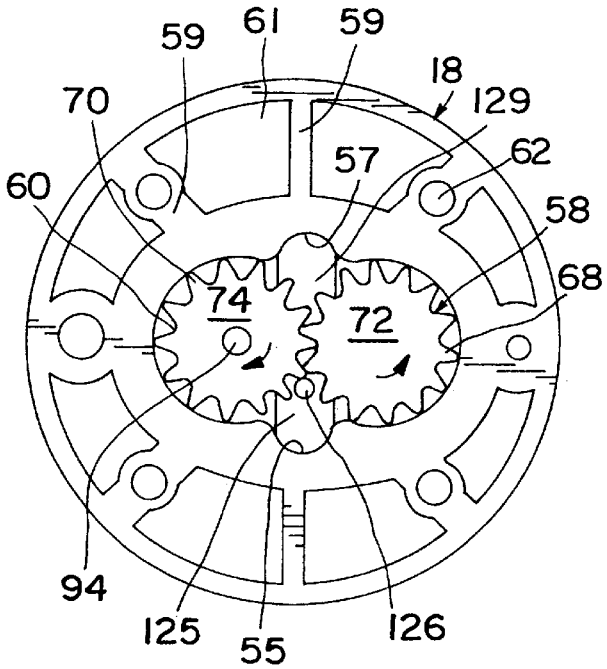
FIG. 4 is a top view of a body of the pump assembly shown in FIGS. 1 and 2.

A top view of base 20 is shown in FIG. 3. Drive bearing channels 88 and 90 formed in drive bearing 80 can be seen. Port 126 is also visible. FIG. 4 shows a top view of body 18 mounted adjacent base 20. Port 126 is visible. When drive gear 58 is rotated in a counterclockwise direction in this figure and driven gear 60 is thereby rotated in a clockwise direction, a fluid flowpath is defined from port 34 through port opening 38 of cover 14 to port 44. Next fluid in port 44 flows through channel 55 in body 18 to cavity 125 in base 20. Next, a majority of fluid in cavity 125 is transported to channel 57 by gear teeth 68 and 70. This fluid then flows to port 42 in cover 14 and out of assembly 10 via opening 36 and port 32. A portion of the fluid in cavity 125 not transported to channel 57 is, instead, transported through channels 88 and 90 of drive bearing 80 and into cavity 28 of housing 22 and bore 150 of rotor 30. Fluid circulates down to drive bearing 84 through channels 93 and 95, as well as grooves 91. Fluid in cavity 28 of housing 22 collects in groove 127 (see FIG. 5) in base 20, passes through apertures 132 and exits via port 126 back to cavity 125, as generally indicated by arrows 174 and 176. Although a particular flowpath has been illustrated and described, it is to be understood that other directions for this flowpath are within the scope of the present invention. For example, the above-described flowpath could be changed by instead rotating drive gear 58 in a clockwise direction and driven gear 60 in a counterclockwise direction, relative to the reference provided by FIG. 4. Such rotation would cause fluid to enter port 32 instead of 34 and thereby flow through cover 14 through opening 36 into gear pocket 56.

Fluid is circulated through assembly 10, as described above, in order to both lubricate and cool components of assembly 10 such as drive bearings 80 and 84, drive shaft 78, and rotor housing 22. In addition, the above-described flowpath of pump assembly 10 is designed for quick purging of fluids. This helps facilitate changes from one fluid to another. This is an advantage of assembly 10 that allows its use in such fields as medicine where assembly 10 could be used for kidney dialysis.

Figure 6:
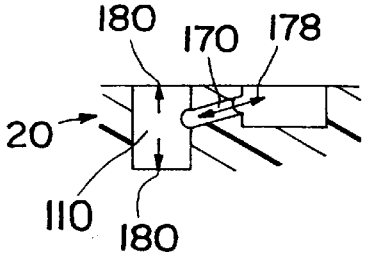
FIG. 6 is a cross-sectional view taken along lines 6—6 of FIG. 3.

The above-described driven gear bearing port 170 in base 20 is shown in FIG. 6. Port 170 provides a fluid flowpath for fluid, generally indicated by double-headed arrow 178 and arrows 180 to flow to driven gear bearing 96 to help cool this bearing. As discussed above and shown in FIG. 1, cover 14 includes a substantially similar driven gear bearing port 168 for driven gear bearing 96.

As shown, for example, in FIG. 1, base 20 may be formed to include a sawcut or channel 188 in fluid communication with cavities 82 and 110. Sawcut 188 routes fluid trapped between points where gear teeth 68 and 70 mesh to cavities 82 and 110, thereby adding to fluid flowing through channels 88 and 90 and port 170, as described above. Routing fluid in this manner helps unload bearings 78 and 80 which otherwise carry an increased load from this trapped fluid. A similar sawcut or channel 190 may be formed in cover 14, as shown in FIG. 2, to route fluid between teeth 68 and 70 to port 168.

Assembly 10 is put together so that centers of bores 92 and 186 are substantially aligned by placing alignment spacer 128 on drive bearing 80 so that inner periphery 130 of alignment spacer 128 is adjacent outer periphery 86 of drive bearing 80. This assembly is next positioned adjacent flange 164 of rotor housing 22 so that alignment spacer 128 is disposed in open end 24 of rotor housing 22, thereby positioning outer periphery 140 of alignment spacer 128 adjacent inner periphery 142 of rotor housing 22. Alignment spacer 128 also helps reduce lateral shifting or movement of body 20 relative to housing 22.

The materials of assembly 10, such as cover 14, cover plate 16, body 18, base 20, rotor 30, and alignment spacer 128, are chosen for compatibility or inertness with fluids pumped by assembly 10. It is desirable to keep components of assembly 10 from reacting with such fluids and thereby contaminating them. Such materials also help prevent attack of the pump structure by the fluids. Although particular materials have been identified for various components of assembly 10, it is to be understood that other compatible or inert materials may be used without departing from the scope of the present invention.

As discussed above, rotor housing 22 can be made from a liquid crystal polymer. Such material has relatively long molecules compared to other plastics and can be molded through a small opening to align these molecules in thin strands. This gives added strength and toughness to rotor housing 22. In addition, liquid crystal polymer materials are substantially chemically inert with many fluids which helps prevent contamination of such fluids and attack of the pump structure. Molding rotor housing 22 through a small opening helps reduce "knit-lines" that result when an element is formed by having a plurality of material flow fronts meet one another. Molding rotor housing 22 also allows drive bearing 84 to be rigidly coupled in closed end 26 by, for example, ultrasonic welding, to help maintain alignment of its center with the center of drive bearing 80 which may also be ultrasonically welded in base 20. Molding rotor housing 22 from a liquid crystal polymer also provides for good heat insulation over rotor housings made from other materials, such as metal, thereby keeping heat away from electronic components, such as circuit component 147 and circuit board 149.

As discussed above, rotor 30 is a multi-piece assembly including a body 148, a tube 152, a magnet 154, and a shell 156. Body 148 can be molded from a polyphenylene sulfide polymer to include a bore 150 and a key 146 extending along a longitudinal length of body 148 and directed toward a center of bore 150. Body 148 may be made from other similar polymers as well. Tube 152 is made from a ferromagnetic material, such as steel, and provides a flux flowpath for magnet 154. Shell 156 is coupled to body 148 as shown to thereby encapsulate magnet 154. In one embodiment, shell 156 is made from stainless steel. However, shell 156 can be made of non-metallic materials, such as plastic, that have a high structural integrity. Magnet 154 is bonded to tube 152 and this subassembly is inserted into shell 156, ends 158 and 160 of which are rolled over or turned as shown and this assembly is placed in a mold where body 148 is formed. Magnet 154 has a plurality of poles and, in one embodiment, is a four-pole magnet to maximize magnetic flux density. Although four poles are disclosed, it is to be understood that in other embodiments of the present invention, fewer or more poles may be used. Magnet 154 may be made of neodymium, iron, and boron.

Drive shaft 78 and driven gear shaft 94 may be coated with a hard chrome plating for wear. In one embodiment, the thickness of this chrome plating ranges from one ten-thousands to two ten-thousands of an inch (0.0001"–0.0002") and has a hardness from approximately 60 to 70 on the Rockwell C Scale.

Figure 7:
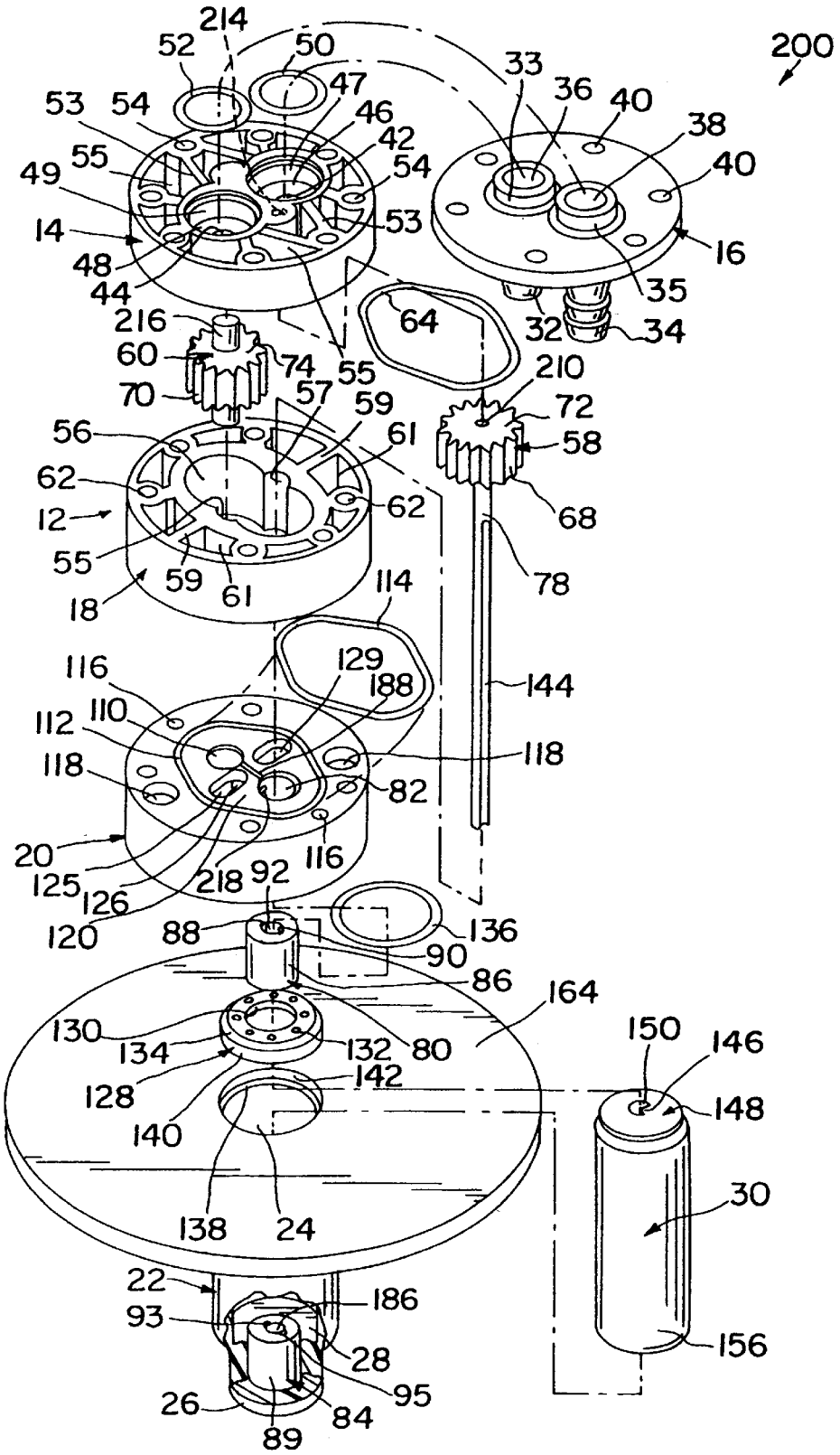
FIG. 7 is an exploded perspective view of an alternative embodiment of a pump assembly constructed in accordance with the present invention.
Figure 8:
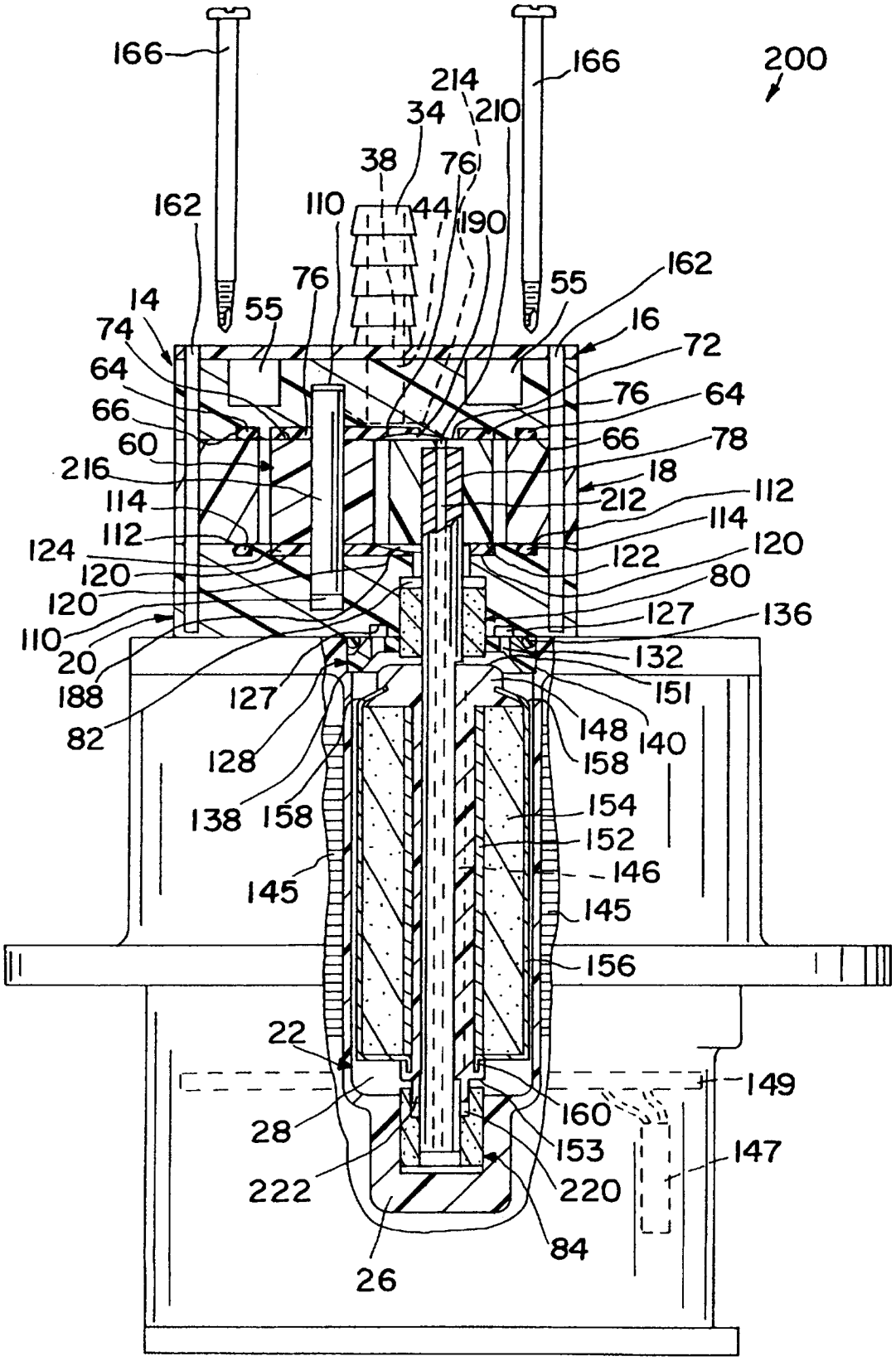
FIG. 8 is a longitudinal cross-sectional view of the pump assembly shown in FIG. 7.

An alternative embodiment of a pump assembly 200 constructed in accordance with the present invention is shown in FIG. 7 and 8. Assembly 200 includes many of the components of assembly 10. Identical reference numerals are used in FIG. 7 and 8 for those components of assembly 200 that are the same as the components of assembly 10.

Assembly 200 includes a longitudinally extending bore 210 through drive gear 58. A longitudinally bore 212 is also formed in drive shaft 78. Bores 210 and 212 are substantially aligned with one another so that fluid can pass therethrough via port 214 formed in cover 14. Driven gear 60 of assembly 200 is not journaled within driven gear bearings, as with assembly 10. Rather, driven gear 60 is coupled to a driven gear shaft 216 that is disposed directly within cavities 100 and 110 formed in respective cover 14 and base 20.

A port 218 is formed in base 20 as shown in FIG. 7. Port 218 is designed to equalize pressure on either side of drive gear 58 so that fluid flows through bores 210 and 212 as described below.

Figure 10:
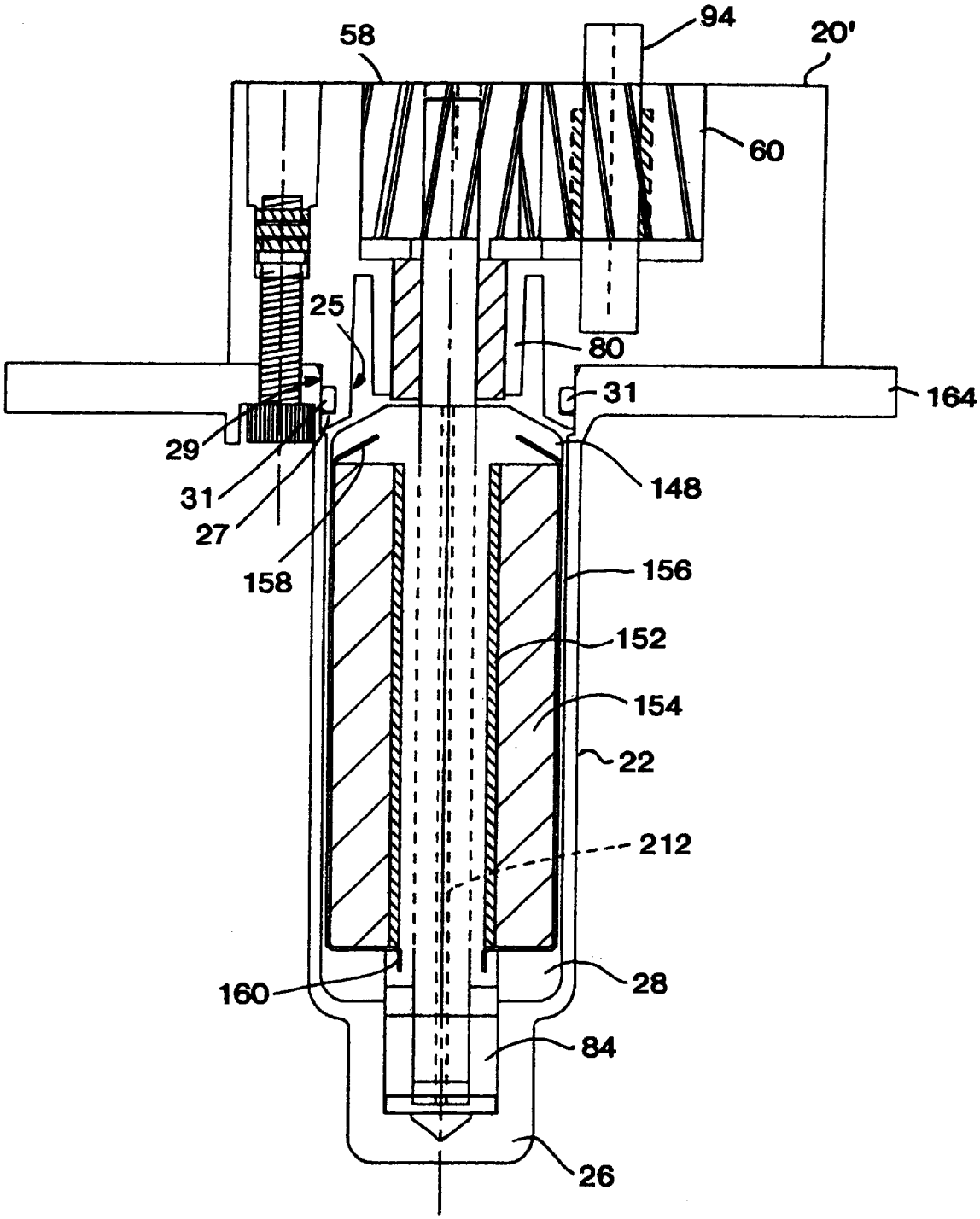
FIG. 10 is a longitudinal cross-sectional view of the pump assembly shown in FIG. 9.

As shown in FIG. 8, according to one embodiment drive bearing 84 can be formed to include a recessed counterbore 220 and body 148 of rotor 30 can be formed to include a nose 222. In such an embodiment, nose 222 of body 148 can be disposed in and adjacent to recessed counterbore 220 to define a clearance between nose 222 and bearing 84 through which fluid can flow. Alternatively, neither the recessed counterbore 220 nor nose 222 are included as depicted in FIG. 10.

Rotation of drive gear 58 in a counterclockwise direction and rotation of driven gear 60 in a clockwise direction defines a fluid flowpath from port 34 through port opening 38 of cover 14 to port 44. Next, fluid in port 44 flows through channel 55 in body 18 to cavity 125 in base 20. A majority of this fluid in cavity 125 is next transported to channel 57 by gear teeth 68 and 70. A majority of this fluid then flows to port 42 in cover 14 and next out of assembly 10 via opening 36 and port 32. Fluid not flowing from port 42 and out of assembly 10 via opening 36 and port 32 instead flows through port 214 which is coupled to opening 38 into bores 210 and 212 down to drive bearing 84. Fluid is next circulated between drive shaft 78 and bearing 84. A portion of this fluid next flows between shaft 78 and bore 150 of rotor 30 up to groove 127 and another portion flows through the clearance between nose 22 and bearing 84 into cavity 28 up to groove 127. Fluid collecting in groove 127 in base 20 next passes through apertures 132 of alignment spacer 128 and exits via port 126 to cavity 125.

Although a particular fluid flowpath has been illustrated and described for assembly 200 as with assembly 10, it is to be understood that other directions for the flowpath for assembly 200 are within the scope of the present invention. For example, the above-described flowpath for assembly 200 could be changed by instead rotating drive gear 58 in a clockwise direction and driven gear 60 in a counterclockwise direction. Such rotation would cause fluid to enter port 32 instead of port 34 and thereby flow through cover 14 through opening 36 into gear pocket 56.

As shown, for example, in FIG. 7, base 20 of assembly 200 may be formed to include the above-described sawcut or channel 188 in fluid communication with cavities 82 and 110. Additionally, as shown in FIG. 8, cover 14 of assembly 200 may include the above-described sawcut or channel 190.

Assembly 200 may be formed from the same materials described above in connection with assembly 10. Furthermore, assembly 200 may be made from the same or a similar method as assembly 10.

Figure 9:
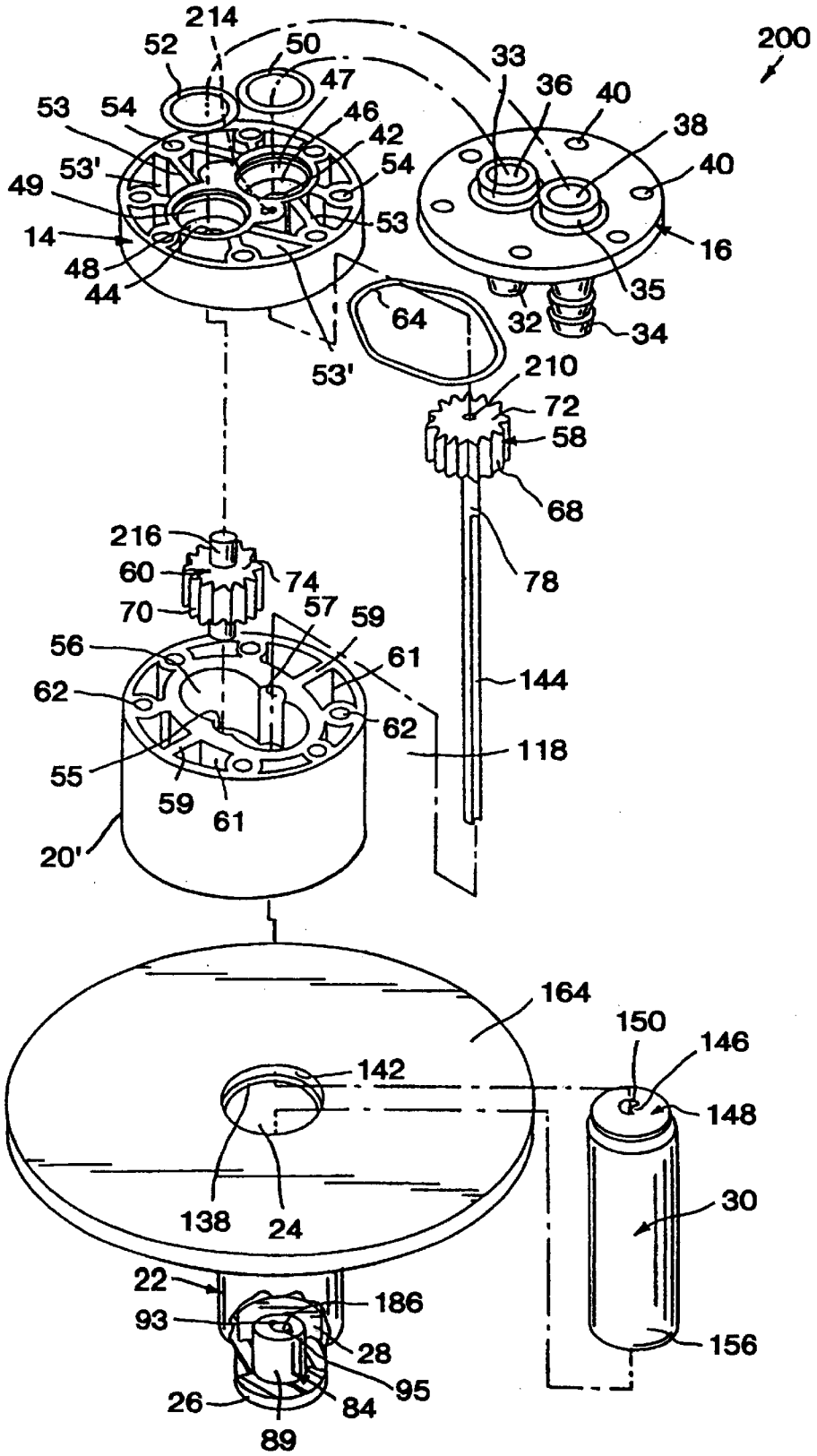
FIG. 9 is an exploded perspective view of a pump assembly constructed in accordance with a further embodiment of the present invention.

FIG. 9 is an exploded perspective view of a pump assembly constructed in accordance with a further embodiment of the present invention. In the embodiment of the invention depicted in FIG. 9, the body and base of the pump assembly 200 together with the alignment spacer are formed together as an integral unit or structure with the drive bearing molded therein. This integral structure is referred herein as pump block 20'. Pump block 20' includes the combined structures of the body 18, base 20, and alignment spacer 128 as depicted in FIG. 7, with the exclusion of the seal 114 and groove 112. Seal 114 and groove 112 are not required since there is no interface between the body 18 and base 20 which needs to be sealed. The other structural elements as shown, including gear pocket 56, channels or grooves 55 and 57, drive gear cavity 82 and driven gear cavity 110, cavities 125 and 129, ports 126 and 218, and channel 188 are all included in the pump block 20'. In the embodiment of the invention depicted in FIG. 9, dowels are not required to effect alignment of the pump body and pump base. Accordingly, as depicted, the dowel apertures 118 of FIGS. 1 and 7 are not included. Fastener apertures 116 are included and used to secure the pump assembly to rotor housing.

The pump block 20' is produced by a molding process in which drive bearing 80 and insert 120 are positioned in a mold prior to injection molding. These elements are thus in effect molded into the pump block 20'. The molded pump block can be finished by a machining process as desired.

As discussed above, alignment spacer 128 can be provided with a plurality of apertures 132 which are disposed in a symmetrical manner. As mentioned, these apertures 132 provide for fluid communication between base 20 and cavity 28 of rotor housing 22. According to one embodiment of the invention depicted in FIGS. 9 and 10, a cylindrical groove 132' was used in place of apertures 132, when the alignment spacer 128 was formed as an integral portion of the pump block 20'. The use of a cylindrical groove 132' is considered to be equivalent to an infinite number of apertures 132, symmetrically arranged about alignment spacer 128.

The upper portion of the pump block 20' may be formed with the walls 59 and cavities 61 of the body 12 illustrated in FIG. 7 if desired.

FIG. 10 is a longitudinal cross-sectional view of the pump assembly shown in FIG. 9. As depicted in FIG. 10, the lower portion of the pump block 20' can include an annular lip 25 which projects outward from a lower portion of the pump block 20' and which annular lip 25 includes a groove 27 in an outer surface 29 thereof This groove 27 is provided to receive a seal member 31. The annular lip 25 is designed to position the seal member 31 against an inner surface of rotor housing 22 as depicted an effect a fluid tight seal between the pump block 20' and the rotor housing 22.

The pump assemblies of FIGS. 7–8 and 9–10 operate in a similar manner to circulate fluid to bearing 84. That is, during a fluid pumping operation, fluid pressure created by the pump gears forces a portion of the fluid through port 214 and into bores 210 and 212. The fluid travels down bore 212 of the drive shaft and exits the end thereof and flows upward through bearing 84 and through channels 93 and 95. The fluid enters cavity 28 and flows upward between shell 156 and rotor housing 22, through alignment spacer, and into groove 127. The fluid next passes through port 126 and cavity 125 and enters the inlet of the gear pocket 56.

From the preceding description of the preferred embodiments, it is evident that the objects of the invention are attained. Although the invention has been described and illustrated in detail, it is to be clearly understood that the same is intended by way of illustration and example only and is not to be taken by way of limitation. The spirit and scope of the invention are to be limited only by the terms of the appended claims.

What is claimed is:

1. A pump assembly, comprising:

a frame;

a stator coupled to the frame;

a rotor associated with the stator and including a bore;

a housing configured to define a cavity in which the rotor is disposed, the cavity including an open end and a closed end;

a pump element driven by the rotor and stator and including a body attached to the housing and a pump chamber, said body including an inlet through which fluid enters the assembly and an outlet through which fluid exits the assembly, the body being configured to include a port in fluid communication with the pump chamber;

an alignment spacer adjacent the open end of the housing and the body of the pump element, the alignment spacer being configured to include a plurality of apertures in fluid communication with the port and the cavity of the housing, the alignment spacer reducing lateral shifting of the pump relative to the housing;

a bearing secured in the closed end of the housing and configured to include a bearing port; and a drive member journaled in the bearing and configured to include a longitudinally extending bore therethrough to define a fluid flowpath through the bore in the drive member, to the bearing port, to the cavity and the bore of the rotor, to the apertures in the alignment spacer, and through the port in the body of the pump.

2. The pump assembly of claim 1, wherein the bearing is configured to include a recessed counterbore and an end of a body of the rotor is configured to include a nose disposed in the recessed counterbore to define a clearance between the nose and the bearing through which fluid in the fluid flowpath flow.

3. The pump assembly of claim 1, wherein the drive member includes a shaft journaled in the bearing and configured to include a longitudinally extending bore therethrough and a gear coupled to the shaft and configured to include a longitudinally extending bore therethrough, substantially aligned with the bore of the shaft.

4. The pump assembly of claim 1, wherein the alignment spacer is integrally molded with the pump body to form an integral structure, and said plurality of apertures comprise an annular opening.

5. The pump assembly of claim 1, wherein the bearing includes a channel adjacent the bearing post.

6. A pump assembly, comprising:

a frame;

a stator coupled to the frame;

a rotor associated with the stator and configured to include a bore;

a housing configured to define a cavity in which the rotor is disposed, the cavity having a closed end and an open end;

a single bearing provided in the housing and being secured in the closed end of the housing to define a housing bearing;

a pump element disposed adjacent to and driven by the rotor and stator; and a shaft having a longitudinal bore therethrough coupled to the pump element, disposed within and extending through the bore of the rotor, and journaled in the housing bearing.

7. The pump assembly of claim 6, wherein the pump element includes a gear and the housing bearing includes a bearing port, the gear includes a longitudinally extending bore therethrough which bore is substantially aligned with the longitudinal bore of the shaft so that a fluid flowpath is defined through the bore in the gear and the longitudinal bore in the shaft, to the bearing port in the housing bearing, and to the cavity and the bore of the rotor.

8. The pump assembly of claim 7, wherein the housing bearing is configured to include a recessed counterbore and an end of the rotor is configured to include a nose disposed adjacent the recessed counterbore to define a clearance between the nose and the recessed counterbore of the housing bearing through which fluid in the fluid flowpath flows.

9. The pump assembly of claim 6, further comprising a pump bearing in which the shaft is journaled, the pump bearing being positioned in the pump element.

10. The pump assembly of claim 6, wherein the housing is configured to include a flange adjacent the open end and the pump element is attached to the flange.

11. The pump assembly of claim 6, further comprising an alignment spacer adjacent the open end of the housing and the pump element, the alignment spacer reducing lateral shifting of the pump element relative to the housing.

12. The pump assembly of claim 11, wherein the pump element includes a body and the alignment spacer is integrally molded with the body of the pump element.

13. The pump assembly of claim 12, wherein the alignment spacer includes an annular aperture in fluid communication with the pump element and the cavity of the housing.

14. The pump assembly of claim 11, wherein the pump element includes a body, and further comprising a seal disposed between the alignment spacer and the pump element.

15. The pump assembly of claim 6, further comprising:

a pump bearing in which the shaft is journaled, the pump bearing being secured in the pump element; and an alignment spacer adjacent the open end of the housing and the pump element, the alignment spacer facilitating alignment of a center of a bore through the housing bearing with a center of a bore through the pump bearing.

16. The pump assembly of claim 15, wherein the open end of the housing has an inside periphery and the pump bearing has an outside periphery, and further wherein the alignment spacer includes an outside periphery in contact with the inside periphery of the open end of the housing and an inside periphery in contact with the outside periphery of the pump bearing to facilitate the alignment of the center of the bore through the housing bearing with the center of the bore through the pump bearing.

17. The pump assembly of claim 16, wherein the pump element includes a body, and further comprising a seal disposed adjacent the outside periphery of the alignment spacer, the inside periphery of the open end of the housing and the pump element.

18. The pump assembly of claim 15, wherein the alignment spacer is configured to include a plurality of apertures in fluid communication with the pump element and the cavity of the housing thereby defining a fluid flowpath including the pump element, the alignment spacer, and the cavity of the housing.

19. The pump assembly of claim 18, wherein the housing and pump bearings are configured to each include a channel, the channel in the housing bearing is in fluid communication with the cavity, and the channel in the pump bearing is in fluid communication with the pump element and the cavity of the housing.

20. The pump assembly of claim 19, wherein a fluid flowpath is defined from the pump element through the channel in the pump bearing, through the cavity, the channel in the housing bearing, the bore in the rotor, through the alignment spacer, and back to the pump element.

21. The pump assembly of claim 19, wherein the housing and pump bearings are each configured to include a groove formed in an outside periphery of the bearing through which fluid circulates to help cool the bearings.

22. The pump assembly of claim 15, wherein the rotor includes a body configured to have a pair of opposing ends that provide thrust surfaces for contact with the housing and pump bearings.

23. The pump assembly of claim 6, wherein the shaft is disposed in the bore of the rotor so that the rotor is substantially restricted from longitudinal movement about an axis of the shaft and substantially unrestricted from movement in a direction along the longitudinal axis.

* * * * *